US009568203B1

(12) United States Patent
Small et al.

(10) Patent No.: US 9,568,203 B1
(45) Date of Patent: Feb. 14, 2017

(54) SYSTEM AND METHOD FOR ACTIVE HUMIDIFICATION OF HOLLOW-BODIED WOOD INSTRUMENTS

(71) Applicants: Austin Small, Lower Gwynedd, PA (US); Jesse McTernan, State College, PA (US)

(72) Inventors: Austin Small, Lower Gwynedd, PA (US); Jesse McTernan, State College, PA (US)

( * ) Notice: Subject to any disclaimer, the term of this patent is extended or adjusted under 35 U.S.C. 154(b) by 0 days.

(21) Appl. No.: 14/985,618

(22) Filed: Dec. 31, 2015

(51) Int. Cl.

| | |
|---|---|
| ***F24F 3/14*** | (2006.01) |
| ***F24F 6/06*** | (2006.01) |
| ***G10G 7/00*** | (2006.01) |
| *F24F 6/00* | (2006.01) |

(52) U.S. Cl.
CPC . *F24F 6/06* (2013.01); *G10G 7/00* (2013.01); *F24F 2006/008* (2013.01)

(58) Field of Classification Search
CPC ..... F24F 2006/008; F24F 3/14; F24F 6/12; F24F 6/14
See application file for complete search history.

(56) References Cited

U.S. PATENT DOCUMENTS 4,362,090 A * 12/1982 Whiteley ..... F24F 3/16 126/113
4,643,351 A * 2/1987 Fukamachi ..... B01F 3/0407 236/44 E
5,501,076 A * 3/1996 Sharp, III ..... F25B 21/02 62/3.2
5,584,286 A * 12/1996 Kippax ..... A62B 7/00 128/200.24
5,803,247 A * 9/1998 Holmes ..... A24F 25/02 206/213.1
5,936,178 A * 8/1999 Saari ..... A24F 25/02 84/453
6,209,717 B1 * 4/2001 Flynn ..... G10G 7/005 206/204
6,592,107 B1 * 7/2003 Wong ..... F24F 6/02 261/107
2002/0070129 A1 * 6/2002 Tunstall-Behrens ... B65D 85/64 206/204
2003/0034573 A1 * 2/2003 Mulvaney ..... F24F 6/043 261/26
2003/0167901 A1 * 9/2003 Lalonde ..... G10G 7/00 84/453
2004/0022675 A1 * 2/2004 An ..... A61L 9/02 422/29
2004/0217026 A1 * 11/2004 Neilson ..... A45C 11/24 206/314

(Continued)

*Primary Examiner* — Allana Lewin Bidder
*Assistant Examiner* — Kun Kai Ma
(74) *Attorney, Agent, or Firm* — Massina Pat & TM Law PLLC

(57) ABSTRACT

A device for providing active, closed-loop humidity control to the environment surrounding and within a hollow-bodied wood instrument. The device includes at least one humidity sensor, and preferably two, one for monitoring the environment's humidity, and one for monitoring the device's response. With data from these humidity sensors, a microcontroller determines whether the system should take action to increase the humidity of this environment by controlling a vapor-generating device. Water is supplied to this device by a water reservoir.

15 Claims, 16 Drawing Sheets

(56) References Cited

U.S. PATENT DOCUMENTS

| | | | | |
|---|---|---|---|---|
| 2005/0258554 | A1* | 11/2005 | Bachert | F24F 6/043 261/3 |
| 2007/0023940 | A1* | 2/2007 | Siess, III | G05D 22/02 261/131 |
| 2007/0204741 | A1* | 9/2007 | Ramos | G10D 3/02 84/291 |
| 2007/0278702 | A1* | 12/2007 | French | F24F 6/02 261/79.2 |
| 2008/0000252 | A1* | 1/2008 | Lee | F24F 1/025 62/291 |
| 2008/0032119 | A1* | 2/2008 | Feldhahn | A61M 16/06 428/332 |
| 2008/0128926 | A1* | 6/2008 | Hsu | F24F 6/02 261/81 |
| 2010/0012739 | A1* | 1/2010 | Hoeth | G10G 7/00 236/44 C |
| 2010/0065054 | A1* | 3/2010 | Bowman | A61M 16/00 128/204.21 |
| 2010/0107325 | A1* | 5/2010 | Lorenz | E03B 3/28 4/363 |
| 2012/0234166 | A1* | 9/2012 | Markham | A61L 9/20 95/214 |
| 2013/0175362 | A1* | 7/2013 | Lee | F24F 6/14 239/302 |
| 2014/0232022 | A1* | 8/2014 | Chung | B05B 15/065 261/78.1 |

* cited by examiner

SYSTEM AND METHOD FOR ACTIVE HUMIDIFICATION OF HOLLOW-BODIED WOOD INSTRUMENTS

FIELD OF THE INVENTION

This invention relates to musical instruments. More specifically, the present invention relates to a system and method for providing environmental humidity regulation for hollow-bodied wood instruments.

BACKGROUND OF THE INVENTION

It is well known that the moisture content in wood-bodied instruments has a significant impact on an instrument's structural integrity and tonal quality. Excessive drying may cause cracks along ring-lines of the wood or at the interface of two wood sections, usually glued together. Arid conditions may also result in deformations to the soundboard, affecting the position of the "bridge" and resulting in misalignment of the strings with respect to the neck. Deformations, also referred to as bowing, bending, or warping, may also contribute to a separation between the soundboard and the bridge of a guitar or between the body and neck of most wood-bodied instruments. Therefore, it is essential to prevent the wood from drying out. A humidifier placed inside the instrument (or instrument case) acts to add water vapor to the air in and surrounding the hollow body of the instrument. The rate of humidification depends on relative humidity differences between humidified air and air near the instrument's wood surfaces.

Previous attempts to humidify hollow-body instruments have been proposed. Those attempts involve the use of a passive (or open-loop) technique that relies on assumed vapor pressure differentials with no feedback from active, accurate sensors.

Some of the prior inventions designed to address humidity concerns are moisture rich containers placed inside an instrument's protective carrying case. Perforations in the container allow moisture to leave the container and to diffuse throughout the case, ultimately entering into the hollow body of the instrument. However, as noted over 50 years ago by HOLLANDER (U.S. Pat. No. 3,407,700), the case is typically vapor permeable and permits water vapor to escape from the case. This limits the amount of water vapor that can potentially enter the hollow body of the instrument. Additionally, the moisture that remains in the case rarely enters the sound hole, and thus rarely enters the hollow body, which is a significant issue, since the most sensitive surfaces of a wood instrument to the humidity of the ambient environment are the unprotected surfaces inside the instrument. With the humidification device placed within the instrument's case, but not inside the instrument, the problem of too little moisture entering the hollow body of the instrument arises for two reasons: (1) the small size of the sound holes limits the amount of humidified air that can diffuse into the wood instrument and (2) the humidified air must travel a significant distance to contact the unprotected surfaces inside the instrument, which probabilistically decreases the chance that the humidified air will contact these surfaces. As yet another issue, the moisture content of these inventions is quickly exhausted, requiring users to refill the containers frequently. Additionally, passive humidification means may also be detrimental to the instrument, since the adjusted humidity could still remain inaccurate.

Despite the severe limitations presented above in humidifying a case, efforts of this type continued. BERLINER (U.S. Pat. No. 3,431,038) increased the water capacity. EGBER (U.S. Pat. No. 8,748,723) considered using a saturated aqueous solution encased in a semipermeable membrane. Some of the problems with semipermeable pouches include (but are not limited to): the restriction to use aqueous solutions that do not chemically react with the packaging, the potential for release of undesirable gases (such as hydrogen sulfide), a limited moisture transfer capacity (only a fraction of the moisture in the package can be used for humidification), and the need for a specific pouch for a specific environment or desired humidity range. Another problem is that use of these products involves weighing the package before installation and then periodically afterward to calculate the remaining moisture content—a prohibitively cumbersome task.

A significant improvement to humidifiers consists of placing the humidifying device inside the hollow body rather than in the case. HOLLANDER (U.S. Pat. No. 3,407,700) disclosed a snake-like structure that is inserted into the hollow body through the sound hole. Inside the device is a damp, spongy material. Placing the humidifier inside the wood instrument mitigates the problem presented above of humidified air entering the sound hole. Regardless, water vapor can still leave the sound hole and the case. In addition, these inventions require frequent maintenance of the moisture source and do not provide the user with critical details about the environment inside the hollow body. Variations to this idea include VON MYER (U.S. Pat. No. 3,721,152), LASKIN (U.S. Pat. No. 4,572,051), LIGHT (U.S. Pat. No. 5,289,751), and HEPPLE (U.S. Pat. Nos. 8,087,645/8,220,782).

BLACKSHEAR (U.S. Pat. No. 4,649,793) improved the prior state of the art by proposing a mechanism to seal off the hollow body in order to mitigate the effect of moisture loss to the ambient environment. His detailed investigation into moisture loss mechanisms revealed that moisture can penetrate the lacquer or epoxy finish on the outside of an instrument. Therefore, even instruments with the sound hole covered require a humidification device with a large water reservoir, since the water vapor can still escape the enclosed internal environment.

Blackshear also noted the deleterious effect of sudden changes in humidity. "Because wood is viscoelastic, i.e., it can flow as well as elastically deform, greater swings in humidity and the resulting volume changes can be tolerated without crack formation if the changes occur gradually." However, a shock to the system from sudden changes in humidity can ultimately lead to large stresses in the wood resulting in cracks. Although Blackshear mentioned moisture shock in his discussion, his device does not actively control the actual rate of humidification.

The remaining effort in Blackshear's work was in building an improved humidification system that operates under specific but limited ambient conditions. The specificity of this device limits its operation to a narrow range of ambient conditions. In addition, the sponge of this device still needs to be re-wet weekly.

None of the aforementioned inventions provide an indicator of the actual humidity level inside the instrument body. The commercial product Planet Waves Acoustic Guitar Humidifier by D'Addario has a temperature and humidity sensor and display. In addition, it suspends into the hollow body via the strings, and it is filled with a damp, spongy material. However, this product does not cover the sound hole. Furthermore, the output of the Planet Waves humidity sensor does not affect the output of the moist sponge. Consequently, this system is passive and the humidity sensor is useless unless the user regularly monitors it.

In fact, all of the previously mentioned inventions are passive (open-loop) systems. Terms used in prior patents such as "auto regulation" or "self-regulating" are misnomers that imply that these devices incorporate active closed-loop humidity regulation. Instead, these devices stop producing an output when vapor pressure reaches equilibrium, not when a user-defined set point is reached, which may be above or below the equilibrium value. Furthermore, the majority of these devices do not measure the humidity of the environment.

The inventor, Shengxie Nangong (CN 201804543 U), combined some of the features of the prior art to produce a sound-hole cover with a snake-like sponge that penetrates into hollow body. There is also a hydrometer that displays the current humidity level. However, like the other prior art, this system is passive, is incapable of achieving a desired set point, and needs to be maintained frequently.

In summary of the prior art: the performance of the prior art is heavily bounded by initial ambient conditions (i.e. if the initial ambient humidity is too low, an equilibrium may never be reached), the permeability of the instrument, the permeability of the case (if used), and the diligence of the user to frequently inspect the humidifying device; many of the semipermeable pouches contain toxins or corrosive elements; the moisture transfer capacity of the prior art is low; most devices do not display the actual humidity level in the hollow body or the case; the prior art does not control the humidification rate to address moisture shock, and the prior art does not actively control the output of the moisture-generating device.

SUMMARY OF THE INVENTION

To maintain a specific moisture content in the air in contact with the wood for a wide range of ambient conditions and wood conditions, it is necessary to have an active (or closed-loop) system that monitors the humidity levels and can inject water vapor into the body as desired to achieve a predetermined humidity level. Our invention addresses all of the aforementioned concerns.

Contrary to the prior art systems above, in at least one embodiment, the present system allows for active humidity control of the environment inside and surrounding a hollow-bodied instrument by monitoring the environment's humidity level and adjusting the humidification rate accordingly. Note that in order for this system to regulate the humidity of the environment surrounding the wood instrument, this environment should be reasonably confined. Furthermore, in at least one embodiment, the present system can regulate an instrument's internal environmental humidity while overcoming challenges presented by the external ambient environment (i.e. moisture loss through the sound hole), and the permeability of the case (if used), by operating inside the wood instrument, and by sealing the instrument's sound hole(s). In addition, in at least one embodiment, the present system overcomes the problem of moisture loss through the instrument's wood body by accommodating a relatively large water reservoir. In at least one embodiment, the present system requires minimal user input, merely to refill the water reservoir as needed, but no input related to monitoring or optimizing the system's performance. In at least one embodiment, the present system offers a high rate of moisture transfer and a high moisture transfer capacity, facilitated by an energy consuming water vaporization technique. In at least one embodiment, the present system controls the humidification rate in order to avoid moisture shock. In at least one embodiment, the present system uses only water to humidify the instrument's environment, avoiding the use of any toxins or corrosive elements. In at least one embodiment, the present system monitors and displays the actual humidity level of the instrument's environment for user convenience.

In at least one embodiment, the present system includes a water reservoir, a vapor-generating device, and a humidity sensor, allowing for active closed-loop humidity regulation of an instrument's internal and external (but reasonably confined) environment. By actively monitoring the environment's humidity level with the humidity sensor, the system can adjust the environment's humidity level towards a desired value, vaporizing water from the reservoir to enact this desired change.

In at least one embodiment, the present system includes a vapor-transmission device, such as tubing, which allows the system to regulate the humidity of the instrument's internal environment while bypassing its external environment. This technique offers the same benefits as placing the humidification device inside the instrument: effective humidity regulation is offered for the instrument's internal environment, which is in contact with the instrument's most sensitive wood surfaces; unnecessary vapor generation/loss is avoided by not releasing water vapor to the instrument's external environment, where much less water vapor would reach the instrument's internal environment, and where the instrument's surfaces are protected and therefore much less sensitive to humidity levels.

In at least one embodiment, the present system covers the instrument's sound holes, thereby separating the instrument's internal and external environments. This enhances humidity regulation of the instrument's internal environment by preventing water vapor loss. The system's mechanism for covering the sound holes may be incorporated into the vapor-transmission device, or may be part of a single self-contained humidity regulation unit that fits into the instrument's sound hole(s), among many other possibilities.

In at least one embodiment, the humidity sensor transmits signals to a microprocessor (also identified as a microcontroller or CPU). This microprocessor, which is configured to receive signals from the humidity sensor, can interpret this data, and actively adjust the humidity of the instrument's environment by controlling a vapor-generating device.

In at least one embodiment, this system can perform other tasks to streamline the process of active, closed-loop humidity regulation, such as sending humidity readings to the user through some means of electronic communication, and sending reminders to the user regarding the water level in the water reservoir, among many other facilitative tasks.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
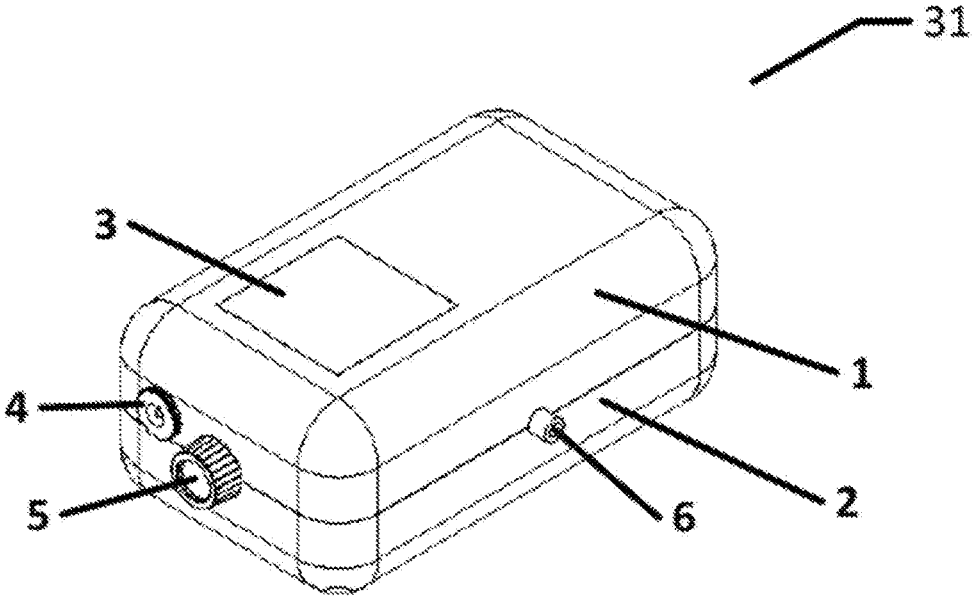
FIG. 1 is a perspective view of an exemplary system.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 15:
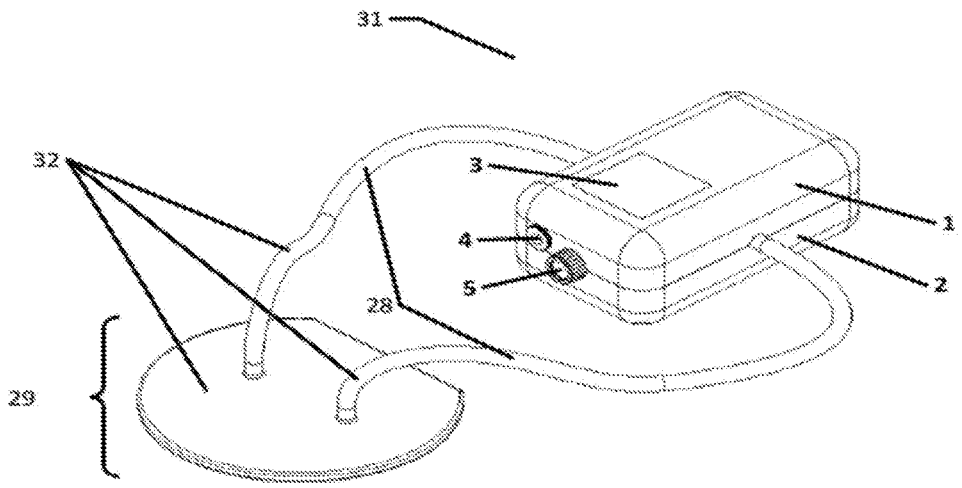
FIG. 15 is a perspective view of the exemplary system with an optional vapor-transmission device attached.
Figure 16:
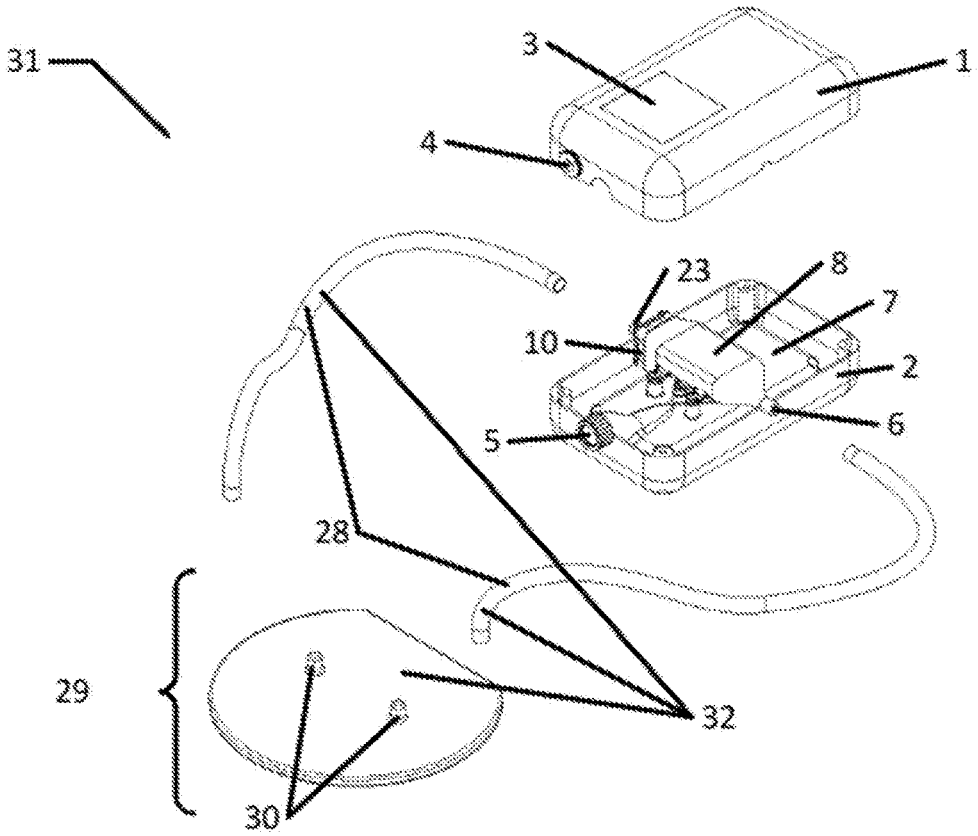
FIG. 16 is a partially exploded perspective view of the exemplary system and optional vapor-transmission device of FIG. 15.

A system 31 in accordance with an exemplary embodiment of the present invention is illustrated in FIGS. 1-14. Referring to FIGS. 1-4, the system 31 generally comprises a water reservoir subunit 15 including a water reservoir 7, a humidification subunit 14 including a vapor-generating device 20 (see FIG. 8), humidity sensors 16 and 17, and an airflow-controlling unit 13 which are enclosed within opposed enclosure members 1, 2. The enclosure is sized to be portable and to fit within a case for a hollow-bodied instrument. As one example, the enclosure is 2 in×2 in×3 in, the approximate size of the pocket inside an acoustic guitar case. FIGS. 15 and 16 illustrate an alternative embodiment of the system 31 further including an optional vapor-transmission device 32, as described hereinafter.

From a high-level operational standpoint, the device continuously pulls air from the surrounding environment into the system. A humidity sensor 16 measures the humidity of the incoming air. Based on this humidity reading, as well as a user-defined preferred humidity, the system determines its response. If the humidity of the environment is greater than the user-defined set point, the system does not react, since the present embodiment does not include a dehumidification unit. It is noted that alternative embodiments may include a dehumidification unit, in which case, the unit would be activated if the humidity environment is greater than the user-defined set point. If the humidity of the environment is equal to the user-defined set point, within a certain threshold, the system again chooses not to react. Finally, if the humidity of the environment is less than the user-defined set point, the system releases water vapor into the air that is guided through the system. This task is completed by the vapor-generating device 20, which generates water vapor from water stored in the water reservoir 7. The airflow is then directed out of the system, but not before a final humidity reading is taken by a second humidity sensor 17. By releasing water vapor into the surrounding environment, the system increases the humidity of the environment towards the user-defined set point. Note that while the first humidity sensor 16 polls data related to the humidity of the environment, the second humidity sensor 17 polls data related to the humidity of outgoing air, which helps the system gauge how much water vapor to release. This functionality also helps in monitoring system health, relating to whether or not the system is functioning correctly. Without the optional vapor-transmission device 32 attached to the system 31, the system 31 impacts air from the immediately surrounding environment. However, with the vapor-transmission device 32 attached to the system 31, the system's impact can be directed towards an enclosed environment, more specifically that of a hollow-bodied wood musical instrument, as described hereinafter.

Figure 2:
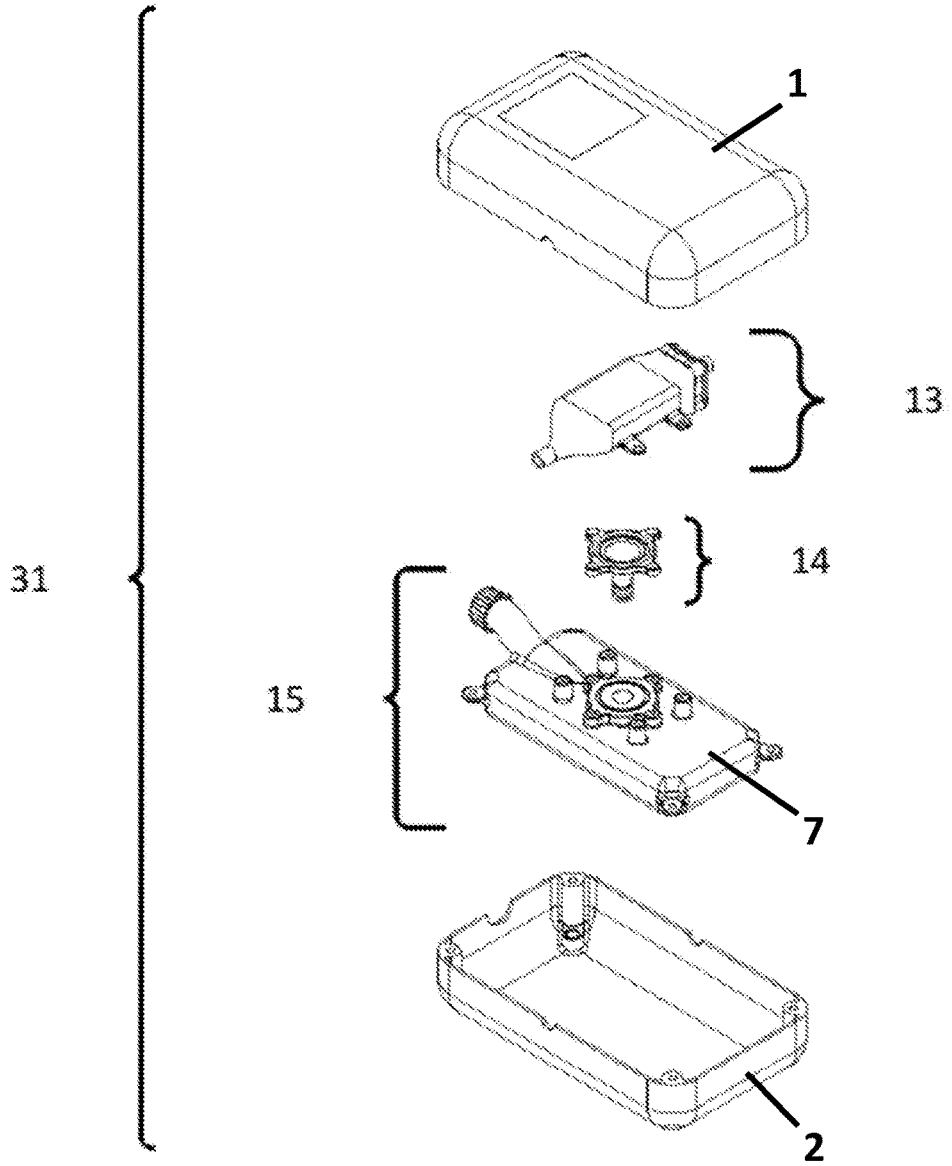
FIG. 2 is a partially exploded perspective view of the exemplary system of FIG. 1.
Figure 3:
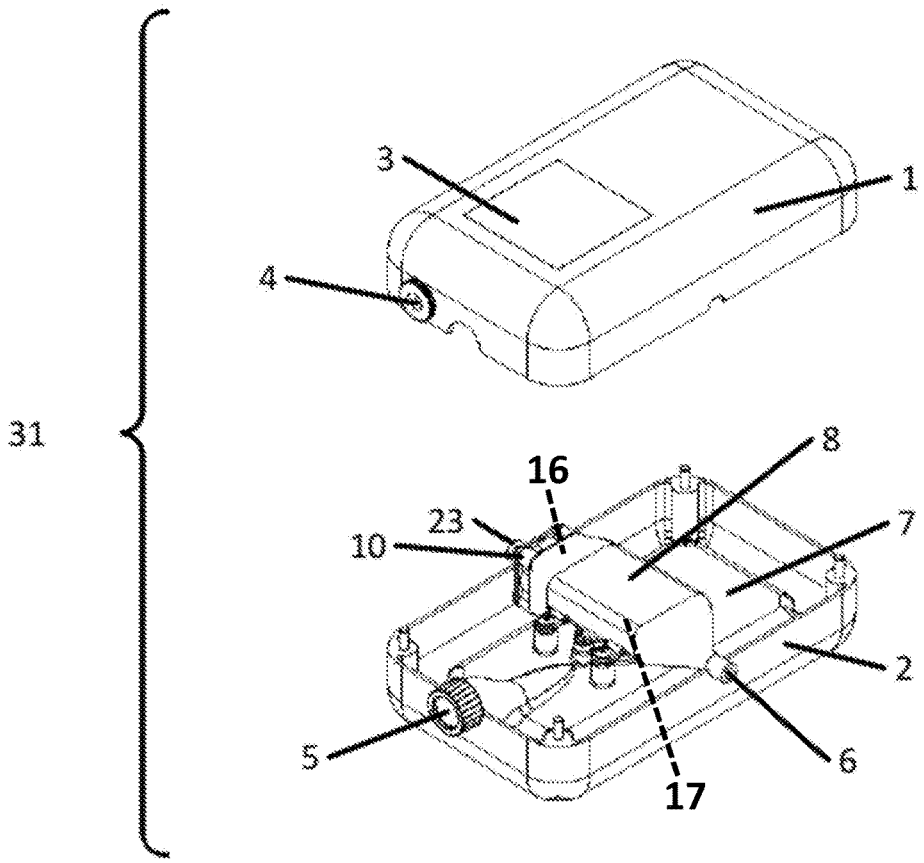
FIG. 3 is a perspective view of the exemplary system of FIG. 1, with the top and bottom components of the system's enclosure separated to depict the internals of the device.
Figure 4:
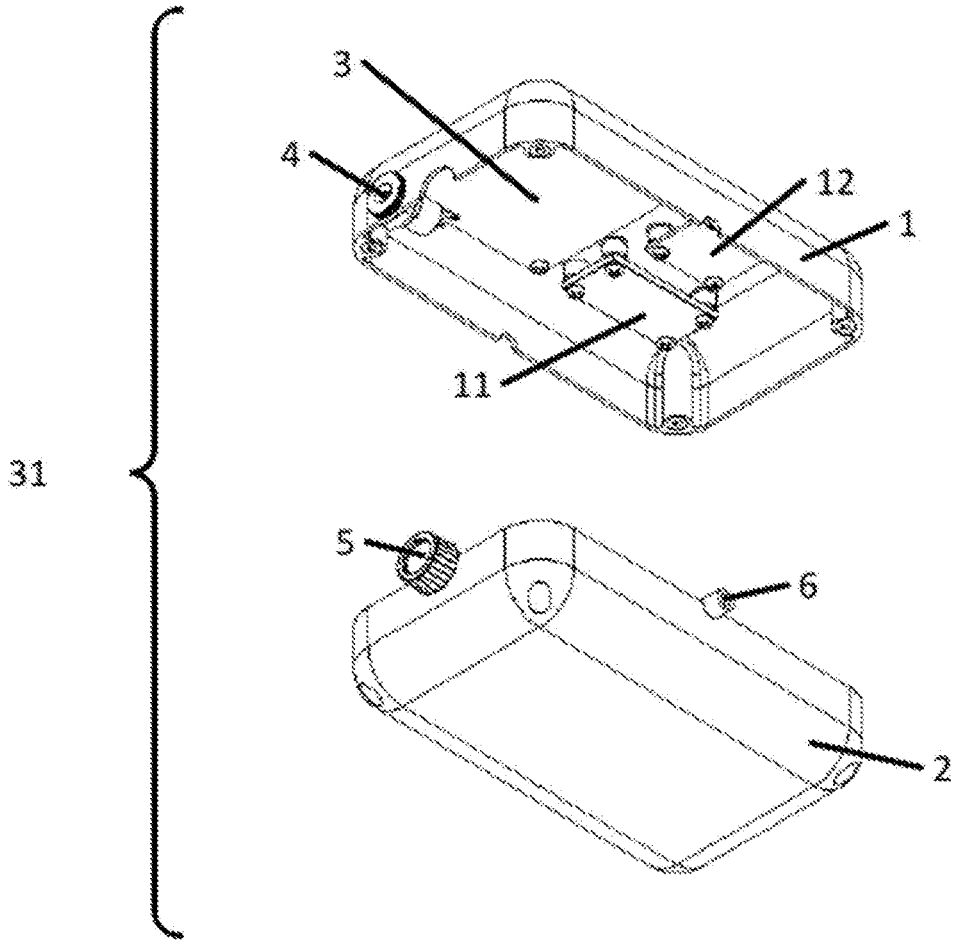
FIG. 4 is a bottom perspective view of the exemplary system of FIG. 1, with the top and bottom components of the system's enclosure separated to depict the internals of the device.

Referring to FIG. 2, the system 31 follows a hierarchical construction where the water reservoir subunit 15 is first attached to the base enclosure 2. A humidification subunit 14, which includes the vapor-generating device 20, is then attached to the water reservoir subunit 15. Subsequently, an airflow-controlling unit 13 is mounted to the water reservoir subunit 15 above the humidification subunit 14. Lastly, a top enclosure 1 is attached to the base enclosure 2, fully enclosing all of these components.

Figure 5:
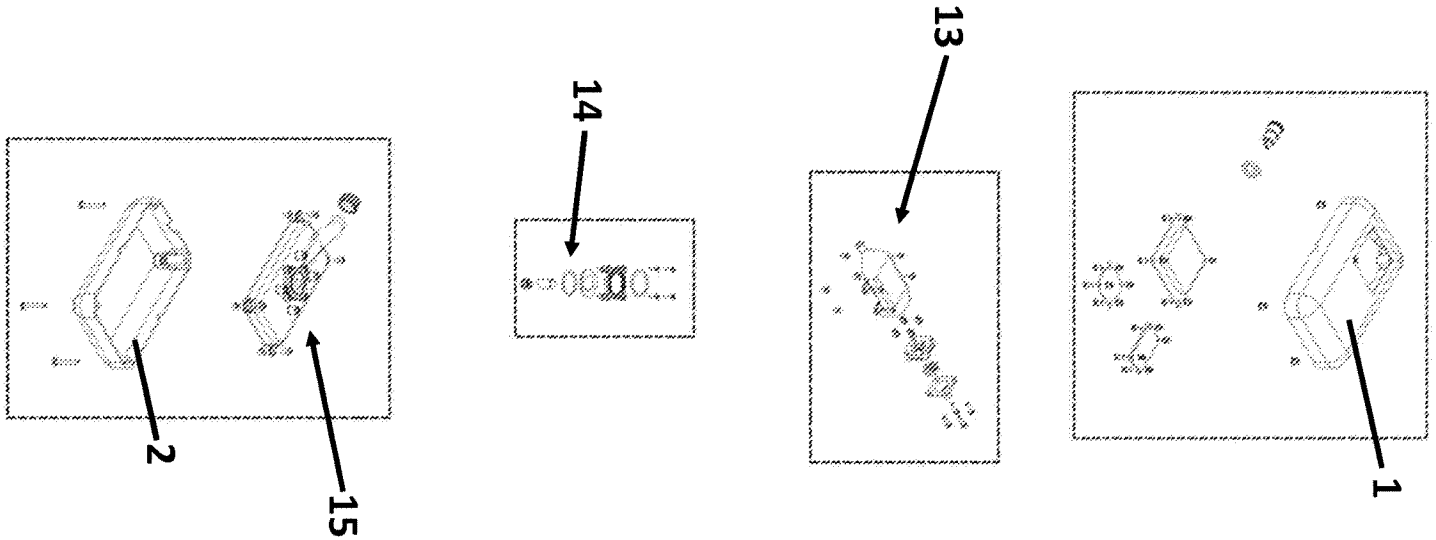
FIG. 5 is an exploded perspective view of the exemplary system of FIG. 1.
Figure 6:
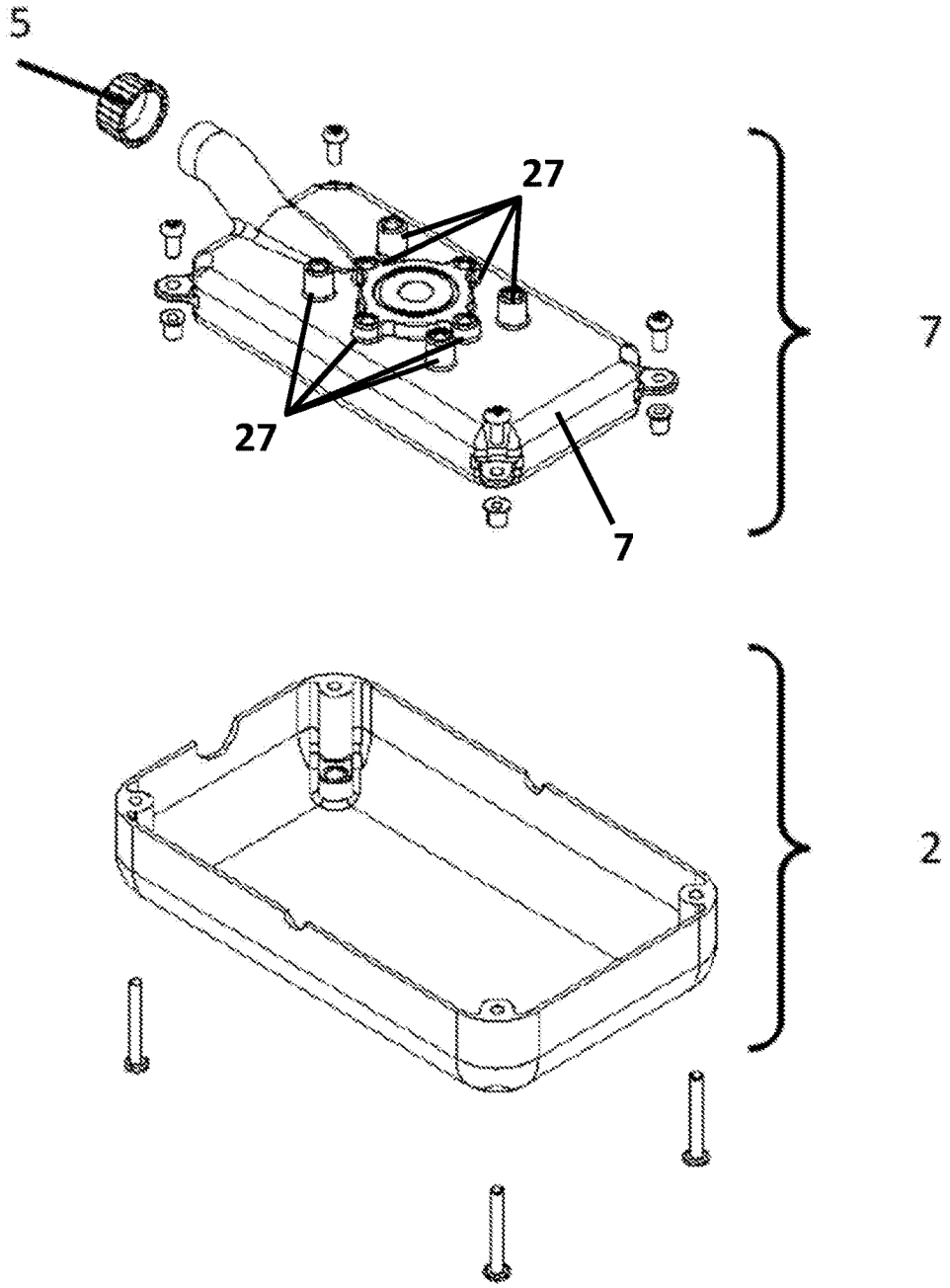
FIG. 6 is an expanded exploded perspective view of a subsection of the exemplary system depicted in FIG. 5.
Figure 7:
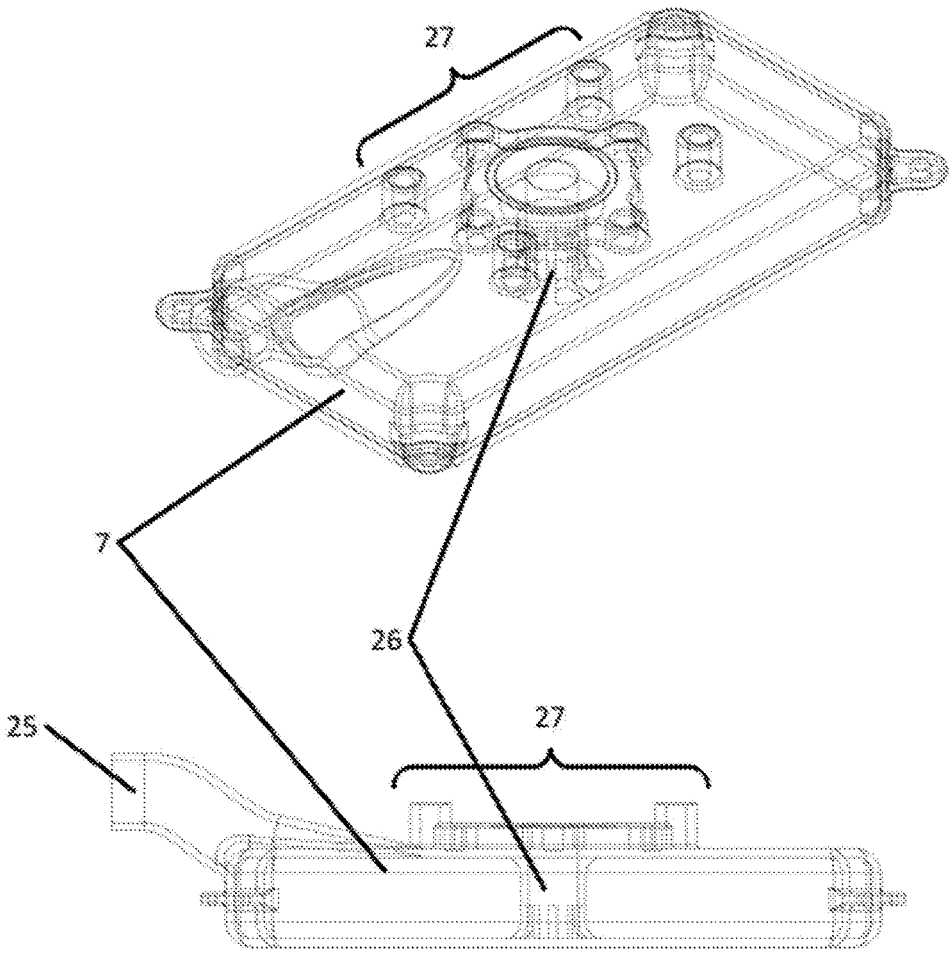
FIG. 7 illustrates perspective and side views of an exemplary water reservoir.

Referring to FIGS. 5-7, and following the hierarchical construction in more detail, the water reservoir 7 is mounted to the base enclosure 2. A cap 5 is screwed onto a spout 25, fitted externally with threads, of the water reservoir 7, allowing for refilling the unit with water. In the illustrated embodiment, the water reservoir 7 has four mounting points 27 each (eight total) for the vapor-generating subunit 14 and the airflow-controlling subunit 13. In addition, located centrally within the water reservoir is a strainer-like structure 26, into which a sponge 21 (part of the vapor-generating subunit 14) is mechanically fitted, which directs water to the vapor-generating device 20. In a preferred embodiment, all internal surfaces of the water reservoir 7 are coated with a sponge-like material (not shown). Through the capillary action of water moving throughout this sponge-like material, water can be directed to the vapor-generating device 20 irrespective of the orientation of the overall system 31.

Figure 8:
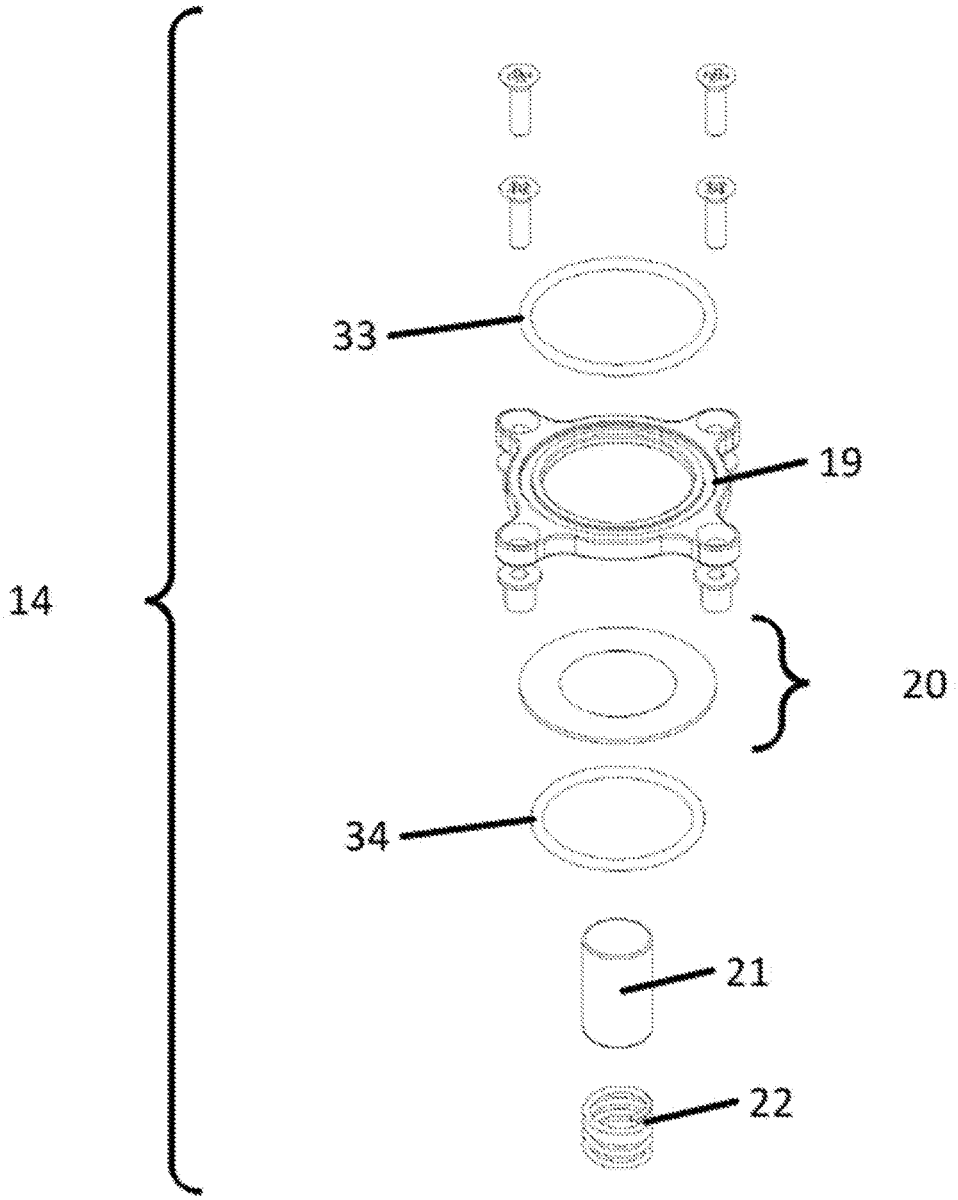
FIG. 8 is an expanded exploded perspective view of a subsection of the exemplary system depicted in FIG. 5.
Figure 9:
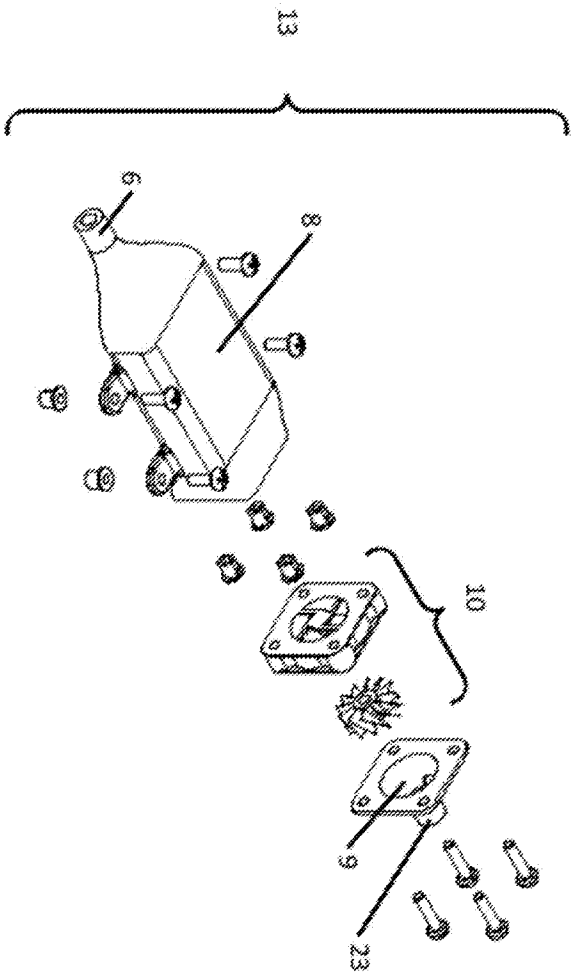
FIG. 9 is an expanded exploded top perspective view of a subsection of the exemplary system depicted in FIG. 5.
Figure 10:
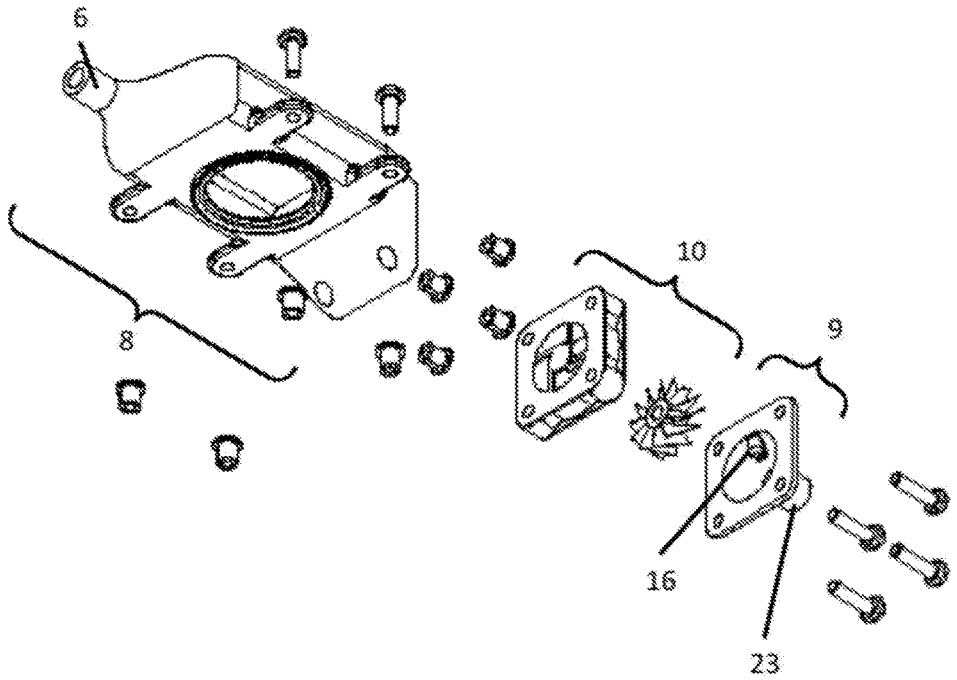
FIG. 10 is an expanded exploded front bottom perspective view of the subsection of the exemplary system depicted in FIG. 9.
Figure 11:
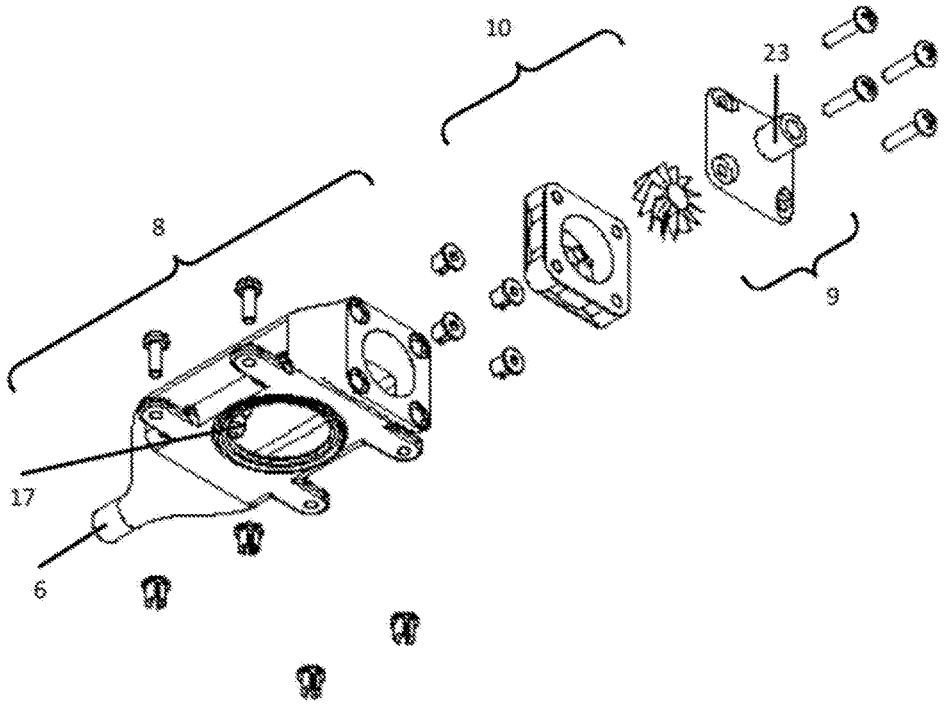
FIG. 11 is an expanded exploded rear bottom perspective view of the subsection of the exemplary system depicted in FIG. 9.
Figure 12:
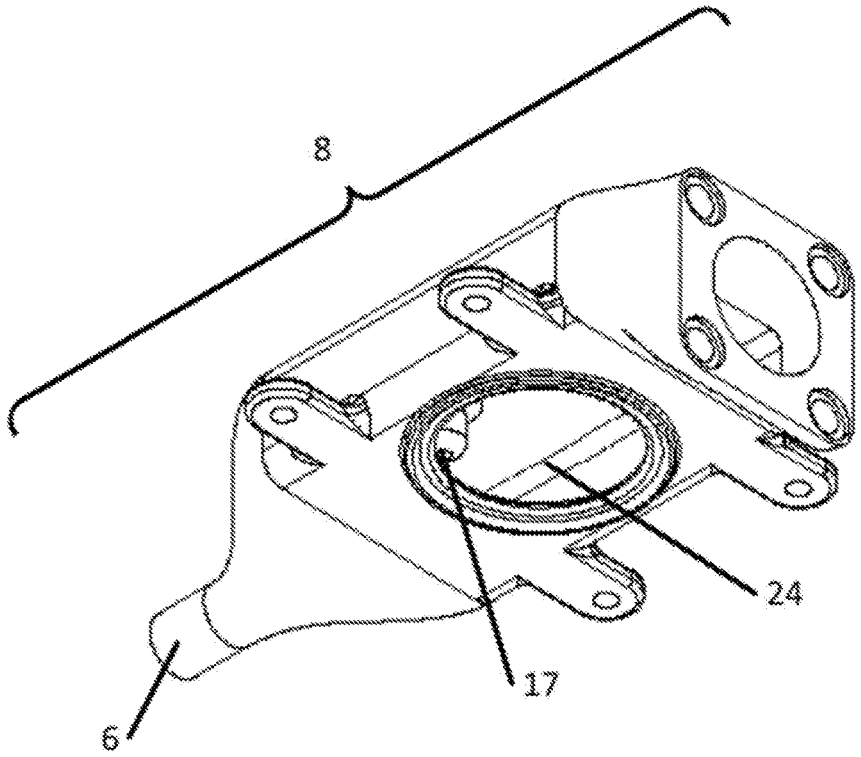
FIG. 12 is a bottom perspective view of a component of an exemplary air ducting system.

Referring to FIG. 8, construction of the vapor-generating subunit 14 includes a spring 22 inserted into the strainer-like structure 26 of the water reservoir 7. This spring 22 promotes a strong contact between the sponge 21 and the vapor-generating device 20. The sponge 21 is inserted into the strainer-like structure 26, on top of the spring 22. An O-ring 34 is placed on top of the water reservoir 7, inside a fitted groove and concentric with the sponge 21. The vapor-generating device 20 is placed on top of the sponge 21 and O-ring 34. This vapor-generating device 20 acts by converting water, contacting the device's bottom surface by means of the sponge 21, into water vapor by vibrating at an ultrasonic frequency. However, it is understood that other vapor-generating techniques may be utilized. A compression mount 19 is placed on top of the vapor-generating device 20 and is attached to the water reservoir 7 by screws or the like. When this compression mount 19 is attached, the spring 22 and O-ring 34 are compressed, and a watertight seal is created (irrespective of the system's orientation, only water vapor can exit this construction). To complete construction of the vapor-generating subunit 14, a second O-ring 33 is placed on top of the compression mount 19.

Referring to FIGS. 9-12, an exemplary airflow-controlling subunit 13 will be described. The airflow-controlling subunit 13 includes a fan 10 attached to the primary air duct 8. A secondary air duct 9 is attached to the opposite side of the fan 10, completing the independent assembly of the airflow-controlling subunit 13. Notably, the secondary air duct 9 contains a humidity sensor 16, which polls humidity data from incoming air passing through inlet port 23 of the secondary air duct 9, allowing the device 31 to determine how it will act in order to bring the humidity of the ambient environment towards to user's pre-defined set point. Furthermore, the primary air duct 8 contains a humidity sensor 17, positioned downstream of a bottom opening 24 which receives vapor from the vapor-generating unit 14, which polls humidity data from outgoing air, allowing the device 31 to evaluate its response. The primary air duct 8 includes an outlet port 6 such that there is a direct airflow from the ambient environment (inlet port 23), into the device 31, and back to the ambient environment (outlet port 6). Optional hosing may be connected to these ports 6, 23 to further direct airflow in the ambient environment. The airflow-controlling subunit 13 is attached to the water reservoir 7 above the vapor-generating subunit 14. Attachment of the airflow-controlling subunit 13 to the water reservoir 7 compresses the second O-ring 33, guaranteeing an airtight path for vapor generated by the vapor-generating device 20. Again, water vapor released from the vapor-generating device 20 rises, entering the primary air duct 8 through the bottom opening 24, before being directed out of the system 31 through outlet port 6.

Figure 13:
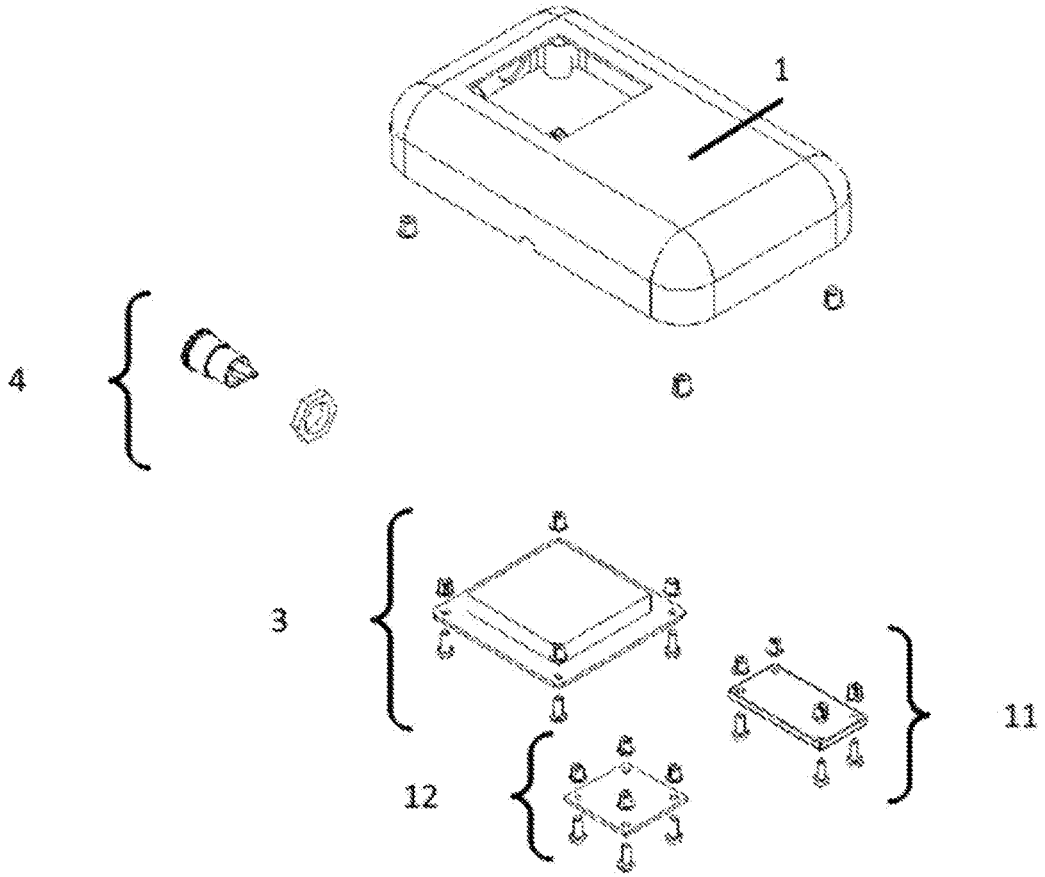
FIG. 13 is an expanded exploded perspective view of a subsection of the exemplary system depicted in FIG. 5.

Referring to FIG. 13, several components are attached to the top enclosure before completing assembly of the overall system 31. A power connection port 4 is connected to the side of the top enclosure 1. An optional display screen/touchscreen 3, which displays useful information such as the environment's current humidity and allows for user input, is also connected to the top enclosure 1. A microcontroller 12 is also attached. Lastly, a unit 11 that includes both a battery and a power distribution module is connected. With assembly of the top enclosure 1 complete, the top and bottom enclosures are now connected to complete assembly of the overall system 31.

Figure 14:
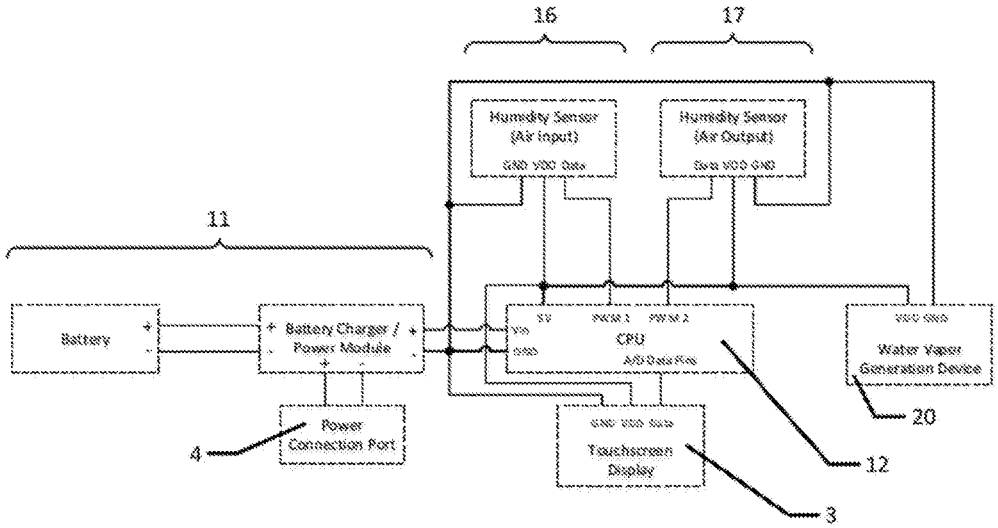
FIG. 14 illustrates an exemplary electrical circuit in accordance with an exemplary embodiment of the system.

As illustrated in FIG. 14, the CPU 12 is configured to receive signals from the two humidity sensors 16 and 17. Humidity data from the first sensor 16 is used by the CPU 12 to determine the environment's humidity, while humidity data from the second sensor 17 is used to determine the effectiveness of the system's response to the environment's humidity. Depending on the environment's humidity, relative to a user-defined set point, the system may decide to release water vapor to this environment in order to raise the humidity by controlling the water vapor-generating device 20.

The exemplary system 31 is powered by a DC input that is connected to the power connection port 4. Due to the operation of a power management module, when a DC input is connected to the power connection port 4, the DC input supplies DC power to both the battery as well as the microcontroller 12. If a DC input is not present, the battery supplies DC power to the microcontroller 12. However, it is understood that other power configurations and sources, for example, solar power, may be utilized. The microcontroller 12 is connected to and configured to send and receive data from the two humidity sensors 16 and 17 as well as the vapor-generating device 20. The microcontroller 12 is also connected to and configured to send and receive data from the touchscreen 3.

Referring to FIGS. 15 and 16, an optional vapor-transmission device 32 may also be included in the overall system 31. This device 32 includes two airflow-directing hoses 28 as well as a sound-hole cover 29. With the vapor-transmission device 32 attached to the system 31, the system's impact can be directed towards an enclosed environment, more specifically that of a hollow-bodied wood musical instrument. The sound-hole cover 29 fully encloses the internal environment of the wood instrument, such that the system 31 only interacts with air from this enclosed environment. Air is guided from and to this enclosed environment by means of the two airflow-directing hoses 28, which attach to the two inlet and outlet ports 23 and 6. The vapor-transmission device 32, equipped with a sound hole cover 29, partially or fully encloses the internal environment of the wood instrument, allowing the system to regulate the humidity of air inside the instrument.

The system and method described herein provide the ability to actively regulate the humidity of the environment surrounding and within a hollow-bodied wood instrument, utilizing one or more humidity sensors as well as a vapor-generating device. With this system, it becomes possible to control the humidity of this environment with the level of precision necessary to maintain the health of a hollow-bodied wood instrument, a level that cannot be met by existing passive humidification devices. This system addresses other concerns regarding the humidification of wood instruments as well, such as vapor loss due to the permeability of the instrument's case, vapor loss through the instrument's wood body, low moisture transfer capacity, moisture shock due to a high humidification rate, and humidification with toxic substances. This system is also easy to use and requires minimal user input, merely to set a desired humidity level and to occasionally refill the water reservoir. No existing products utilize active humidity control, and no existing products address all of the remaining concerns.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A system for providing active, closed-loop humidity control to hollow-bodied wood instruments, the system comprising:

a portable enclosure;

a water reservoir positioned within the enclosure, the water reservoir defining a water outlet port along a surface thereof;

a water vapor-generating device in sealed engagement with the water reservoir and configured to seal the water outlet port and receive water therefrom;

an air duct with an inlet port and an outlet port, the air duct defining an opening between the inlet port and the outlet port and in sealed communication with the water vapor-generating device;

at least a first humidity sensor positioned proximate to the inlet port; and a control unit configured to receive data from the first humidity sensor and to selectively active the water vapor-generating device in response thereto; and a vapor transmission device including a sound-hole cover with first and second ports defined therethrough and a first length of tubing extends between the inlet port and the first port and a second length of tubing extends between the outlet port and the second port, wherein the vapor transmission device supplies or returns humidified air to or from the hollow-bodied wood instruments through the sound-hole cover.

2. The system of claim 1 further comprising a second humidity sensor positioned within the air duct between the opening and the outlet port, the second humidity sensor providing the control unit with data indicative of the humidity of the air exiting the outlet port.

3. The system of claim 2 wherein the control unit is configured to receive data from the first and second humidity sensors and to selectively active the water vapor-generating device in response thereto.

4. The system of claim 3 wherein the control unit is configured to regulate a rate of humidification based on the data received from the first and second humidity sensors.

5. The system of claim 1 wherein the enclosure has a size less than or equal to 2 in×2 in×3 in.

6. The system of claim 1 wherein a sponge extends from within the water reservoir into engagement with the water vapor-generating device.

7. The system of claim 6 wherein a spring biases the sponge into engagement with the water vapor-generating device.

8. The system of claim 6 wherein the water reservoir has an internal surface lined with a sponge material which is in communication with the sponge.

9. The system of claim 1 wherein the air duct has a linear passage between the inlet port and the outlet port.

10. The system of claim 1 wherein a fan is positioned in the air duct between the inlet and outlet ports.

11. The system of claim 1 further comprising a user interface defined along the enclosure and in communication with the control unit, the user interface including a display and user controls.

12. The system of claim 1 further comprising a power source housed within the enclosure.

13. The system of claim 12 wherein the power source is rechargeable via an external connection.

14. The system of claim 1 wherein activation of the water vapor-generating device includes vibrating the water vapor-generating device at an ultrasonic frequency.

15. A system for providing active, closed-loop humidity control to hollow-bodied wood instruments, the system comprising:

a portable enclosure;

a water reservoir positioned within the enclosure;

a water vapor-generating device in sealed engagement with the water reservoir and configured to receive water therefrom;

an air duct with an inlet port and an outlet port, the air duct defining an opening between the inlet port and the outlet port and in sealed communication with the water vapor-generating device; at least a first humidity sensor positioned proximate to the inlet port;

a control unit configured to receive data from the first humidity sensor and to selectively active the water vapor-generating device in response thereto; and a vapor transmission device including a sound-hole cover with first and second ports defined therethrough and a first length of tubing extends between the inlet port and the first port and a second length of tubing extends between the outlet port and the second port, wherein the vapor transmission device supplies or returns humidified air to or from the hollow-bodied wood instruments through the sound-hole cover.

* * * * *